US005197316A

United States Patent [19]

Gottlieb et al.

[11] Patent Number: 5,197,316

[45] Date of Patent: Mar. 30, 1993

[54] LATCHABLE RETAINER FOR KEYS AND THE LIKE

[75] Inventors: Mark Gottlieb, Annandale, Va.; Roderick F. Bunyea, Westminster, Md.

[73] Assignees: The Black & Decker Corporation, Towson, Md.; Designtech International, Inc., Springfield, Va.

[21] Appl. No.: 612,492

[22] Filed: Nov. 14, 1990

[51] Int. Cl.[5] ..... A44B 15/00

[52] U.S. Cl. ..... 70/456 R; 70/457

[58] Field of Search ..... 70/456 R–459; 24/601.6

[56] References Cited

U.S. PATENT DOCUMENTS

| | | | |
|---|---|---|---|
| 2,816,434 | 12/1957 | Olson | 70/457 |
| 3,696,650 | 10/1972 | Hillis | 70/457 |
| 3,704,605 | 12/1972 | Leopoldi et al. | 70/456 R |
| 3,852,982 | 12/1974 | Faris | 70/457 |
| 3,908,418 | 9/1975 | Stoffel | 70/456 R |
| 4,129,021 | 12/1978 | Brentini | 70/456 R |
| 4,281,527 | 8/1981 | Leopoldi et al. | 70/456 R |
| 4,419,874 | 12/1983 | Brentini | 70/456 R X |
| 4,433,498 | 2/1984 | Bienz | 70/459 X |
| 4,523,442 | 6/1985 | Martin | 70/459 |
| 4,888,970 | 12/1989 | Kinzler et al. | 70/456 R |

*Primary Examiner*—Renee S. Luebke
*Assistant Examiner*—Suzanne L. Dino
*Attorney, Agent, or Firm*—Oblon, Spivak, McClelland, Maier & Neustadt

[57] ABSTRACT

A radio transmitter for vehicle accessories has a key ring including a releasable latch. The latch is attached to a ring strap fixed to the top of the transmitter housing and fits into an opening in the top of the housing. A cam body of the latch is held within the housing by projections extending into a slot in the side of the housing. A latch release member projects from the slot and can resiliently move the cam member for releasing the latch from the housing.

5 Claims, 2 Drawing Sheets

LATCHABLE RETAINER FOR KEYS AND THE LIKE

BACKGROUND OF THE INVENTION

1. Field of the Invention

The present is directed to a latchable retainer. More particularly, it is directed to a key ring latchable to a rigid housing which may contain a radio transmitter.

2. Description of the Related Art

Key rings, per se, are known. Also known are rigid housings for containing automotive accessories. For example, it is known to mount in a rigid housing a radio transmitter for use with a remote door locking/unlocking system, a remote car starter, a remote automotive alarm system, and the like.

SUMMARY OF THE INVENTION

It is an object of the present invention to provide a latchable retainer which can be easily latched and unlatched.

It is a further object of the invention to provide a latchable retainer in the form of a key ring which can be easily latched and unlatched from a rigid housing which can contain an automotive accessory device.

The above, and other, objects are achieved according to the present invention by a matchable key ring including a housing comprising a female member, a flexible ring portion having an end secured to the housing and a male member secured to the ring portion and fittable in the female member. A releasable latch means are formed on the male and female members and are cooperable to retain the male member in the female member. Latch means includes release means extending out of the housing for selectively releasing the male member from the female member in response to manual pressure on the release means.

The above, and other, objects are further achieved according to the present invention by a latchable retainer including a housing having at least a top, two side surfaces and two end surfaces, an opening in the top adjacent one of the end surfaces, and a slot extending in the housing from the opening to the one of the end surfaces, the slot having a first predetermined width. At least one projection extends into the slot from the housing adjacent a corner of the top and the one of the ends, so as to form a passage having a second predetermined width which is less than the first predetermined width. A latch comprises a latch body fittable in the opening and a flexible cam body fixed to the latched body, the cam body having a cam surface and a width less than the first predetermined width and greater than the second predetermined width. The projection presses the cam body toward the latch body as the latch is being inserted in the opening. The projection retains the latch in the housing after the cam body has passed the projection as the latch is being inserted in the opening. A flexible retainer member has ends fixed to the housing and the latch.

In the above structure, the flexible retainer can form a key ring while the housing can contain an automotive accessory.

DETAILED DESCRIPTION OF THE PREFERRED EMBODIMENT

Figure 2:
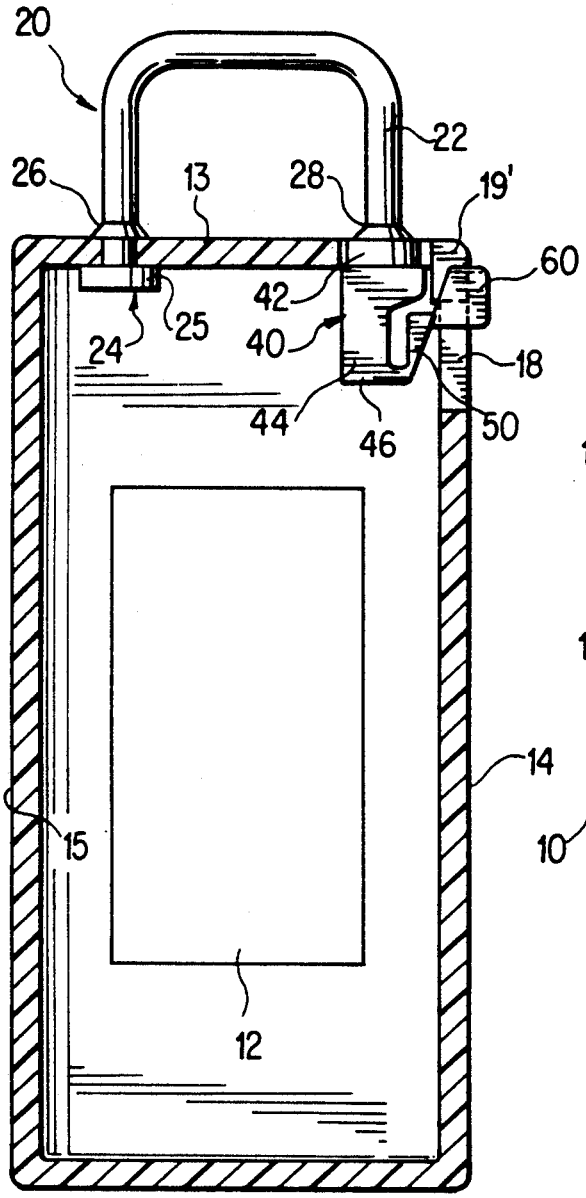
FIG. 2 is a sectional view through section plane 2—2 in FIG. 1.
Figure 3:
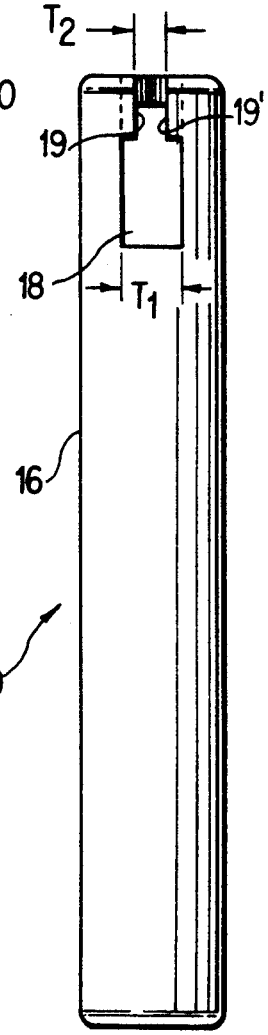
FIG. 3 corresponds to FIG. 1 but shows only the housing.

Referring to the attached figures, in which the same reference numerals are used to refer to the same elements throughout the various views, the latchable retainer according to the invention has three main components: a female member in the form of a housing 10, a flexible retainer member 20 and a male member in the form of a latch 30.

In the preferred embodiment, the housing 10 is in the form of a hollow case formed of rigid material, such as ABS plastic. In a preferred embodiment, the housing is formed of two halves which are fixed to one another (by, e.g., screws, adhesive, etc.) along a parting line corresponding to plane 2—2 of FIG. 1. However, the invention is not so limited and the housing can be formed of any material having portions sufficiently rigid to retain the latch. Also, in the preferred embodiment, the housing retains a radio transmitter 12. For example, the radio transmitter can have one or more buttons **12*a*** accessible from outside of the housing for initiating a radio signal receivable by a vehicle accessory, such as a remote door locking/unlocking device, a remote car starter or a remote car alarm. Such transmitters are, per se, known and will not be further described.

The housing is preferably generally rectangular with rounded ends. For example, it may include a top 13, one end 14, another end 15, and sides 16 and 16'.

An opening 17 is formed in the top and provides access to the interior of the housing. The opening 17 is positioned adjacent the one end 14. A slot 18 is formed in the one end 14 and extends downward from the corner between the one end 14 and the top 13. The slot has a first predetermined width $T_1$ and provides access from the one end to the interior of the housing. Slot 18 extends at **18*a* along the top to the opening 17 and provides, together with the opening 17**, access from above into the housing for a latch, as will be described below.

A pair of opposed projections 19 and 19' extend toward one another into the slot 18 from the sides of the slot. The projections are preferably substantially rectangular and terminate substantially above the bottom of the slot 18. The space between the projections 19 and 19' comprises a passage having a predetermined width $T_2$ which is less than the width $T_1$.

The "ring" portion of the key ring is formed by a flexible retainer member 20 formed of an acetal or nylon. The retainer member has an elongate strap portion 22 having a preferably circular section and preferably preshaped in a generally U-shape. One end 24 of the retainer member is fitted through a hole **13*a* in the top 13 of the housing and terminates in an enlarged end 25. A collar 26 of the retainer member holds the enlarged end 25** against the internal surface of the housing.

The retainer member has another end 28 with which the latch 30, described below, is unitarily formed, for example by one piece injection molding.

The latch is unitarily formed with a latch body 40, a cam body 50 and a latch release member 60. The latch and cooperating portions of the housing form releasable latch means. The latch body is elongate in form and is shaped so that it can be longitudinally inserted into the opening 17. For example, the upper end 42 of the latch body has a sectional shape generally corresponding to that of the opening 17. A shank 44 of reduced thickness extends from the upper portion 42 to a distal end 46.

The cam body 50 is unitarily formed with the distal end 46 of the latch body. It extends from its proximal end 58 in a direction back toward the upper portion 42 of the latch body, but is spaced therefrom by a gap 52. A cam surface 54 of the cam body slopes at an acute angle from the longitudinal direction of the latch body to a distal end 56.

Figure 5:
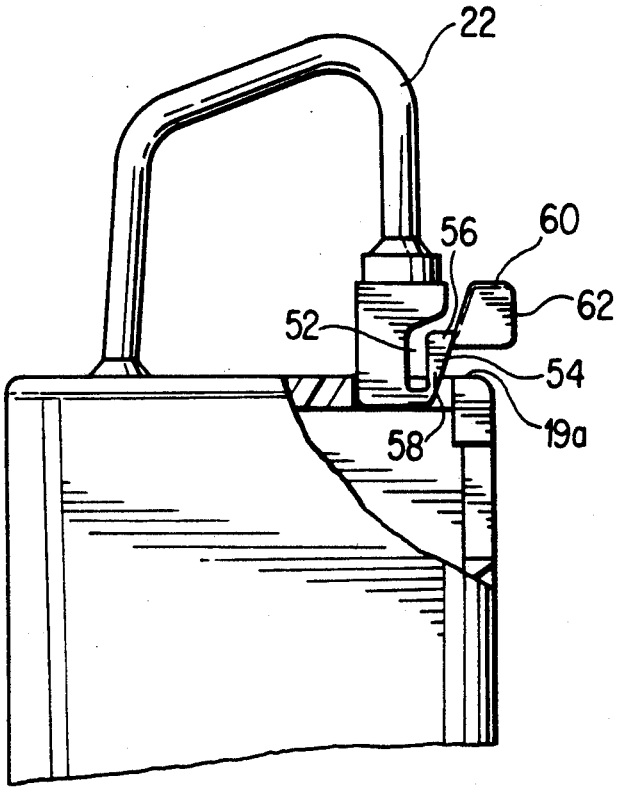
FIG. 5 is a partial front view of the latch retainer according to the invention.
Figure 6:
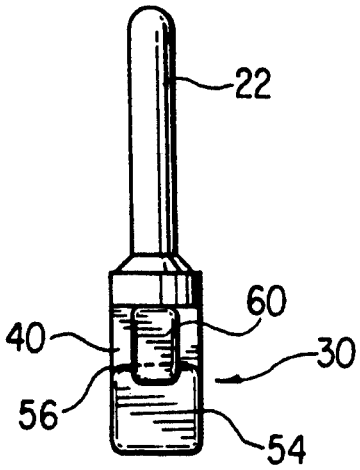
FIG. 6 is an end view of the latch and retainer member.

The cam body has a width which is greater than the width $T_2$ of the passage between the projections 19 and 19', but less than the width $T_1$ of the slot 18. Moreover, as best seen in FIG. 5, the cam surface 54 is angled such that the distal end 56 of the cam body vertically overlaps the edges 19*a* of the projections 19 and 19'. Therefore, as the latch 30 is being inserted longitudinally into the opening 17, the cam surface 54 abuts the edges 19*a*. Additional downward force causes the cam body to bend about its narrow proximal end 58 so that the latch can be further inserted into the housing with the cam body pressing on the projections 19 and 19'.

Figure 7:
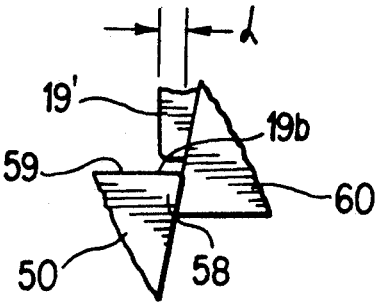
FIG. 7 is a detail of the interaction of the latch with the projection.

As the latch is fully inserted into the housing, the distal end 56 passes the lower ends 19*b* of the projections 19 and 19'. When this occurs, the resilience of the cam body causes it to rebound to its initial position as shown in FIGS. 2 and 7. There, the distal end 56 again vertically overlaps the projections 19 and 19' by the distance d. Therefore, any effort to remove the latch from the housing will be resisted by the upper surface 59 of the cam body abutting against the lower surfaces 19*b* of the projections 19 and 19'. The retainer is thus securely latched.

Figure 1:
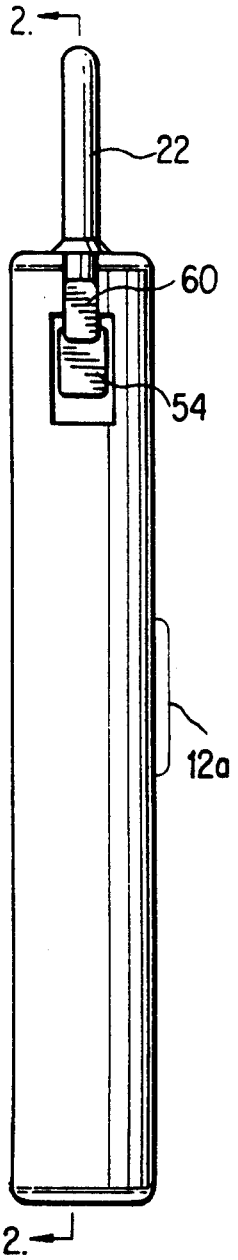
FIG. 1 is an end view of the latchable retainer according to the present invention.
Figure 4:
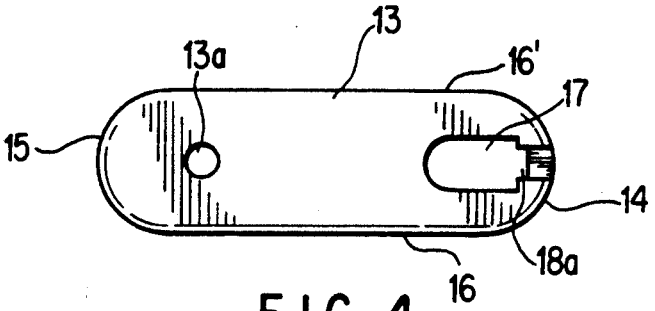
FIG. 4 is a top view of the housing.

The latch release member 60 has a width less than the width $T_2$ of the passage between the projections 19 and 19', as seen in FIG. 1. Therefore, it can pass through the passage as the latch is being inserted into the housing. The end 62 of the latch release member projects from the slot when the latch is fully inserted in the housing by a distance at least equal to d. Therefore, for releasing the latch, one can press on the release member to manually deform the cam body so that the distal end 56 is moved toward the latch body by a degree such that it no longer vertically overlaps the projections 19 and 19'. Then, by lifting on the ring or strap portion 22 one can pull the latch from the housing. Once removed from the housing, additional keys can be added or keys removed, and the latch can then be reinserted into the housing.

Since the retainer member 20 is flexible it provides little resistance to the insertion or removal of the latch in the housing. Moreover, the flexible retainer member can conform to the key shapes and is more comfortable when carried in a pocket.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A latchable retainer comprising:

a rigid housing having at least a top, two side surfaces and two end surfaces;

an opening in said top adjacent one of said end surfaces and extending into said housing;

a slot extending into said housing from said one of said end surfaces, said slot communicating said one of said end surfaces with said opening and having a first predetermined width;

two opposing projections extending toward one another from walls of said slots to form a passage of a reduced second predetermined width;

a flexible retainer member having one end fixed in said housing; and a latch fittable in said opening and comprising:

a) an elongate latch body shaped to fit longitudinally in said opening, said latch body having a proximal end to which another end of said retainer member is fixed and a distal end, and b) an elongate flexible cam body having a proximal end fixed to said distal end of said latch body, said cam body having a width less than said first predetermined width and greater than said second predetermined width, and extending to a distal end projecting back towards said proximal end of said latch body, said cam body having a cam surface sloping at an acute angle from the longitudinal direction of said latch body such that said distal end extends into said slot to engage said projections with said cam surface when said latch is inserted in said opening, whereby said cam body resiliently deforms to permit full insertion of said latch into said housing, and whereby said cam body resiliently rebounds after passing said projections so that said projections retain said latch in said housing.

2. The latchable retainer of claim 1 including a latch release member mounted adjacent said distal end of said cam body and projecting from said cam body in a direction away from said latch body, said latch release member having a width less than said second width, wherein said latch release member can fit into said passage and extends out of said slot when said latch is fully inserted in said housing, whereby manually pressing on said latch release member pushes said cam body towards said latch body so that said distal end of said cam body can pass said projections for removing said latch from said housing.

3. The latchable retainer of claim 2, wherein said retainer member comprises a strap having a sufficient length to be a key chain.

4. The latchable retainer of claim 3, including a radio transmitter mounted in said housing and having at least one button accessible from outside of the housing.

5. The latchable retainer of claim 2, wherein said cam body has a relatively thin portion at said proximal end thereof to provide the flexibility thereof.

* * * * *